United States Patent [19]

Smith

[11] Patent Number: 4,475,867

[45] Date of Patent: Oct. 9, 1984

[54] AXIAL FAN AND NOISE ABATEMENT APPARATUS COMBINATION

[75] Inventor: David A. Smith, Topanga, Calif.

[73] Assignee: General Acoustics Corporation, Los Angeles, Calif.

[21] Appl. No.: 456,545

[22] Filed: Jan. 10, 1983

Related U.S. Application Data

[63] Continuation of Ser. No. 189,321, Sep. 22, 1980, abandoned.

[51] Int. Cl.[3] ..... F04D 29/66

[52] U.S. Cl. ..... 415/119; 415/181

[58] Field of Search ..... 415/119, 181, 182; 181/224, 225

[56] References Cited

U.S. PATENT DOCUMENTS

| | | | |
|---|---|---|---|
| 2,040,452 | 5/1936 | Troller | 415/119 |
| 2,988,302 | 6/1961 | Smith | 415/119 |
| 3,203,180 | 8/1965 | Price | 415/115 |
| 3,481,427 | 12/1969 | Dobbs et al. | 415/119 |
| 3,542,152 | 11/1970 | Adamson et al. | 415/119 |
| 3,949,830 | 4/1976 | Muehlbauer | 181/224 |

FOREIGN PATENT DOCUMENTS

| | | | |
|---|---|---|---|
| 2393960 | 2/1979 | France | 415/118 |
| 1196176 | 6/1970 | United Kingdom | 415/181 |
| 1198549 | 7/1970 | United Kingdom | 181/224 |

*Primary Examiner*—Stephen Marcus
*Assistant Examiner*—Brian J. Bowman
*Attorney, Agent, or Firm*—Fulwider, Patton, Rieber, Lee & Utecht

[57] ABSTRACT

An axial fan having a central fan structure from which a plurality of blades extend radially and a center body extending axially from said central fan structure. The center body occupies a volume in which turbulence would otherwise occur. At least one side branch resonator is disposed within the center body to attenuate resonance produced by said fan in a particular frequency band.

6 Claims, 4 Drawing Figures

AXIAL FAN AND NOISE ABATEMENT APPARATUS COMBINATION

This is a continuation, of application Ser. No. 189,321, filed Sept. 22, 1980, now abandoned.

FIELD OF THE INVENTION

The present invention relates to noise abatement apparatus, and, more particularly, to such apparatus used in combination with axial fans.

BACKGROUND OF THE INVENTION

The present invention is concerned with the abatement of noise generated by axial fans. The term "axial fan" is used here to refer to any fan of the general type in which the flow of air or other gas is in a direction parallel to the axis about which the fan blades rotate. This class of fans includes the common propeller fans in which there is no shroud as well as tube axial fans which are located in a shroud, usually a duct. Tube axial fans are often of the vane axial type in which stator vanes are employed to suppress rotational flow in a downstream direction.

There are three known basic techniques for suppressing the noise generated by axial fans. One technique is to position noise absorptive material in regions near the fan or otherwise adjacent to the fluid flow. While this technique is helpful, its effectiveness is limited, particularly in certain frequency ranges. If the absorptive material is positioned in such a way that it does not interrupt the fluid flow, thus minimizing back pressure and increasing fan efficiency, its noise reducing ability is further diminished.

The second known noise abatement technique entails positioning side branch resonators along the path of the fluid flow, particularly in the case of tube axial fans. These resonators, in essence, reflect noise of a particular frequency band causing it to be dissipated in large measure before it escapes from the tube or duct. A properly designed side branch resonator can be highly effective in removing spikes. For example, where there is often a noise spike at the fan blade passage frequency which can be attenuated in this way.

Conventional side band resonators are mounted on the outside of the duct. In many environments, however, there is little or no room available in which to mount a resonator at the desired location. This problem is frequently encountered, for example, in mine shafts where noise abatement is a chronic problem. Although a conventional resonator might be placed inside the duct, it would in this way tend to significantly reduce the cross-sectional area of the flow path and might, therefore, produce more noise than it would remove.

The third known noise abatement technique focuses on the fact that air flow from an axial fan generally follows a path, in the region near the fan, that is of a generally annular configuration, since the fan has a central structure in which its motor is usually housed that blocks flow along the axial center of the path. This creates a central region of noise producing turbulence behind the fan and may produce a similar region in front of the fan.

To eliminate the noise from this source, a center body is sometimes positioned near the fan, on either side or on both sides, to fill the center volume that lies outside the main flow path, thus reducing or eliminating the turbulence. If properly designed, center bodies are effective in reducing noise, although they generally do not eliminate all such turbulence associated noise, partly because there is turbulence between the fan and the center body and because there are discontinuities in the cross section of the flow path attributable to the very presence of the center body itself.

It is a primary objective of the present invention to provide an improved noise abatement apparatus and axial fan combination.

SUMMARY OF THE INVENTION

According to the present invention, an axial fan having a central fan structure from which a plurality of blades extend radially is combined with a noise abatement apparatus that includes a center body and at least one side branch resonator. The center body extends axially from the central fan structure, occupying a volume in which turbulent flow would otherwise occur. The side branch resonator is disposed within the center body to attenuate resonance produced by the fan in at least one frequency band. It is preferable to connect the center body to the central fan structure without any axial separation.

One aspect of a preferred center body that may be particularly advantageous in the case of a tube axial fan resides in a configuration including a transition zone that tapers radially outwardly as it extends from the central fan structure, a central zone of cylindrical configuration that extends from the transition zone, and an end zone that tapers radially inwardly as it extends away from the fan.

This center body configuration is usually most effectively employed on the downstream side of the fan. It may be advantageous, however, to provide a second center body on the upstream side of the fan as well, and, in some situations, the upstream center body might be used alone.

The preferred construction of the resonator includes a resonance chamber that is ported to the outside of the center body at a plurality of circumferentially spaced-apart locations. Multi-stage side branch resonators can be used, in which case it may be advantageous to employ another resonance cavity of toroidal configuration ported at a plurality of circumferentially spaced-apart locations on its inner surface.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

Figures 1, 2, 3, 4:
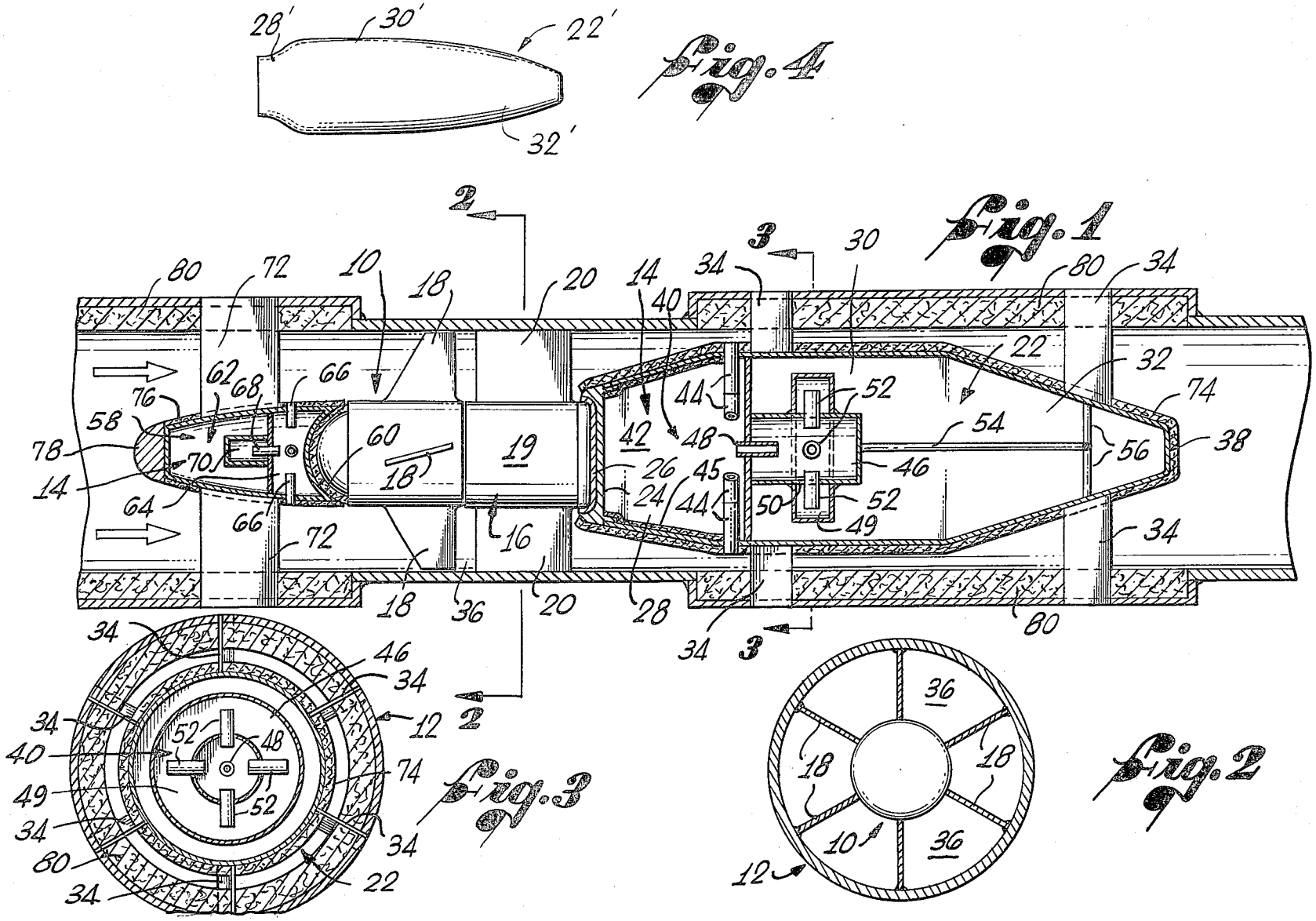
FIG. 1 shows a combination of a tube axial vane fan and a noise abatement apparatus constructed in accordance with the present invention, the noise abatement apparatus being shown in longitudinal cross section taken and substantially along a diameter of the tube.
FIGS. 2 and 3 are cross-sectional views of the apparatus of FIG. 1, taken substantially along the lines 2—2 and 3—3, respectively.
FIG. 4 is a schematic representation of the outline of another center body configuration for use in the invention.

An exemplary axial vane fan 10 is positioned within a duct or tube 12 in combination with a noise abatement device 14, as shown in FIGS. 1–3 of the accompanying drawings. The fan 10 includes a central structure 16 from which a group of blades 18 project radially toward the cylindrical walls of the duct 12. The central structure 16 houses the fan motor 19, and may include a gear box if needed.

The fan 10 is supported by stator vanes 20 that are secured at their radially outer ends to the inside surface of the duct 12 and at their radially inner ends to the motor housing portion of the central fan structure 16 on the downstream side of the blades 18. Functionally, these stator vanes 20 remove or reduce the rotational component of the downstream flow from the fan blades 18.

Immediately adjacent the fan 10 on the downstream side is a center body 22 that is axially disposed within the duct 12 and centered so as to be aligned with the central fan structure 16. The end 24 of the center body 22 facing the fan 10 defines a shallow recess in which the fan is received, an anti-vibration pad 26 being disposed between the fan 10 and the center body. It should be noted that there is no axial separation between the fan 10 and the center body 22 to provide a space in which turbulence could develop.

Considered from the point of view of its configuration, the center body 22 is a figure of revolution that is elongated in the axial direction and includes three distinct zones. A transition zone 28 is directly adjacent the fan 10 and tapers outwardly as it extends away from the fan. Adjacent the transition zone 28 is a cylindrical center zone 30 leading to a terminal zone 32 that tapers inwardly as it extends away from the fan 10. The entire center body 22 is supported on thin radial plates 34 that are aligned with the axial flow along the duct 12 so that any interference with the flow is minimal.

It will be noted that the flow of air or other gas past the fan 10 is blocked at the center of the duct 12 by the central fan structure 16, leaving an annular flow path 36 surrounding the fan (as best shown in FIG. 2). If it were not for the center body 22 behind the fan 10, there would be an unoccupied volume in that region in which separated flow would occur. There would then be a reverse flow into the region in the upstream direction creating an area of high turbulence. This turbulence would generate considerable noise in addition to increasing the back pressure in the duct 12 that would reduce the efficiency of the fan 10.

One purpose of the center body 22 is to occupy this volume or region within which turbulence would otherwise occur, thus reducing the noise as well as the back pressure. Another function of the center body 22 is to create fully developed turbulent flow within the duct 12 on the downstream side of the fan 10, thus minimizing drag. This is accomplished because the center zone 30 of the center body 22 is of a larger diameter than the central fan structure 16, thus forcing the fluid to pass through a generally annular space of reduced cross section between this center zone 30 and the wall of the duct 12. The velocity of the fluid is thus increased. Considering (1) the overall length of the fan 10 and noise abatement apparatus 14 in combination, (2) the diameter of the duct 12, (3) the velocity imparted to the fluid by the fan blades 18, and (4) the Reynolds number of the local flow, the increased velocity adjacent the center zone 30 is sufficient to create fully developed turbulent flow. As the fluid moves along the inwardly tapered terminal zone 32 of the center body 22, the cross-sectional area of the flow path is increased again toward the full cross-sectional duct 12, and the flow is thus diffused.

The terminal zone 32 provides a blunt downstream end 38 on the center body 22. This blunt end 38 is generally to be preferred to a continuous taper leading to a point. Although a continuous taper would eliminate the small turbulence region that exists behind the blunt end 38, it would also increase the surface area of the center body 22, thereby increasing the skin friction. In a typical situation, the added drag attributable to skin friction would more than compensate for the drag reduction due to the absence of turbulence.

The outline of a downstream center body 22′ more closely approaching a theoretically optimized configuration is shown in FIG. 4. The transition zone 28′ has a slightly S-shaped profile on each side, the center zone 30′ is cylindrical, and the end zone 32′ is of increasing inward curvature. Those skilled in the art will be able to calculate the most desirable shape for a particular installation, the objective being to have the profile of the center body 22′ follow a streamline of the fluid flow to promote attached flow. This relatively complex configuration is, however, most suitable for long production runs or for situations in which cost is a secondary consideration.

For shorter production runs and less demanding installations, the center body 22 having a simple and more linear configuration shown in FIG. 1 is appropriate. The transition zone 28 and the end zone 32 are both in the shape of truncated cones. This closer approximation of the optimum shape is usually satisfactory and can be manufactured at a lower cost.

It is also desired to provide a side branch resonator 40 to remove spikes such as those corresponding to the blade passage frequency of motor 19 of the fan 10. The resonator 40 is located within the center body 22 and takes advantage of the boundary layer thickness and velocity profile adjacent to the center body, these parameters being different at this location as compared to the region adjacent to the wall of the duct 12. Being of a multi-stage type the resonator 40 includes a first resonance chamber 42 primarily defined by the transition zone 28 and located immediately behind the motor 10. The resonance chamber 42 is ported to the outside of the center body 22 by a plurality of circumferentially spaced-apart tubes 44, the resonance frequence of the chamber 42 being determined in a manner familiar to those skilled in the art by the length and diameter of the tubes as well as the volume of the chamber itself. The chamber frequency can be varied by filling the chamber 42 with a porous material, and, in some circumstances, it is desirable to line the chamber 42 with a sound absorptive material 45.

The first chamber 42 is connected in series with a second resonance chamber 46 located within the center zone 30 of the center body 22, this second chamber, being connected to the first by a tube 48. A third resonance chamber 49 is of a toroidal configuration and surrounds the second chamber 46. It is ported to the second chamber 46 at circumferentially spaced-apart locations about its inner surface 50 by a plurlaity of tubes 52 that lead to the interior of the second chamber 46, whereby all three chambers are connectd in series. The second and third resonance chambers 46 and 48 are structurally supported by a shaft 54 that extends axially from the center of the second chamber 46 to a plurality of radial rods 56 that are secured to the rearmost support plates 34. Thus, the second and third resonance chambers 46 and 48 are not supported in a cantilevered manner from the first chamber 42. Although series coupled resonance chambers 42, 46 and 48 are used in this exemplary resonator 40, parallel coupling can be employed if desired for a particular installation.

Numerous advantages to locating the resonator 40 within the center body 22 will now be apparent. Use is made of space within the center body 22 which would otherwise be wasted and the need for space external to the duct 12 to contain the resonator 40 is eliminated. In addition, the resonator 40 is protected from damage by the duct 12. Another advantage is that the first resonance chamber 42 can be of a desirable configuration and can be ported to the outside of the center body 22 at any selected locations. The same configuration is advantageously applied in an inverted manner wtih respect to the smaller toroidal third resonance chamber 48 which is ported to the second chamber 42 about its inner surface 50. It will be readily apparent that these chamber configurations could not be employed in a conventional side branch resonator mounted externally of the duct 12.

It may be found, in a particular installation, that the noise of the fan 10 travels upstream through the duct 12 and will be objectionable. Under these circumstances, the noise abatement device 14 includes a second elongated center body 58. This center body 58 is generally bullet shaped, being tapered radially inwardly as it extends away from the fan 10 in the upstream direction. It is insulated from the fan 10 by a pad 60 to prevent the transmission of vibrations, but there is no axial separation that would leave a space adjacent to the fan 10 in which turbulence could occur.

A two-stage side branch resonator 62 is disposed within the forward center body 58 and consists of a first resonance chamber 64 that is ported by two radial tubes 66 to the outside of the body. The first chamber 64 communicates by a tube 68 with a second resonance chamber 70 that is also located within the forward center body 58, acoustically downstream of the first chamber 64. The forward center body 58 is supported plates 72 that extend radially to the inside surfaces of the duct 12 in the same manner as the support plates 34 for the rear center body 22.

To further reduce noise, a sound absorptive lining 74 encloses the entire rear center body 22 and a similar lining 76 is applied to the forward center body 58 with the exception of the rounded nose 78 to which no lining is applied because it would be worn away by the fluid flow due to the acute angle of attack. Additional sound absorptive material 80 is set back from the flow path within annular recesses along the inside of the duct 12. These recesses are of such a depth that they are precisely filled by the absorptive material 80 so that the cross sectional area of the duct 12 available for fluid flow remains constant.

The same advantages that apply to the location of the first resonator 40 within the first center body 22 apply with equal force to the location of the second resonator 62 in the second center body 58.

While particular forms of the invention have been illustrated and described, it will be apparent that various modifications can be made without departing from the spirit and scope of the invention.

I claim:

1. In combination with a duct and an axial fan having a central fan structure from which a plurality of blades extend disposed within said duct, a noise abatement apparatus comprising:

first center body means extending axially from said central fan structure and in alignment therewith in a downstream direction for occupying a first volume in which turbulence would otherwise occur and for creating fully developed turbulent flow, said first center body means being in the shape of a figure of revolution having a transition zone tapered radially outwardly from said central fan structure to a center zone having a diameter substantially greater than that of said central fan structure and a terminal zone tapered radially inwardly, said center zone being dimensioned relative to said duct such that an annular space between said center zone and said duct is reduced compared to an annular space between said central fan structure and said duct, whereby said fully developed turbulent flow is initiated;

first side branch resonator means positioned within said first center body means for attenuating resonance of at least one frequency band produced by said fan;

second center body means extending axially from said central fan structure in an upstream direction for occupying a volume in which turbulence would otherwise occur; and second side branch resonator means positioned within said second center body means for receiving energy traveling upstream through said duct and for attenuating resonance of at least one frequency band produced by said fan.

2. The combination of claim 1 wherein said first and second center body means are connected to said central fan structure without axial separation.

3. The combination of claim 1 wherein at least one of said resonator means includes a plurality of resonance chambers connected in series to form a multi-stage resonator.

4. The combination of claim 3 wherein one of said chambers is a toroidal configuration being ported at a plurality of circumferentially spaced-apart locations on its inside surface.

5. The combination of claim 1 wherein said second center body means is tapered inwardly as it extends away from said fan.

6. In combination with a duct of constant cross-sectional area and an axial vane fan disposed within said duct having a central fan structure from which a plurality of blades extend disposed within said duct, a noise abatement apparatus comprising:

a first elongated center body extending axially from said central fan structure in a downstream direction occupying a first volume in which turbulence would otherwise occur, said first center body being a figure of revolution having a transition zone extending from said central fan structure without any axial separation and tapered radially outwardly as it extends away from said fan, a center zone of a cylindrical configuration having a diameter substantially greater than that of said central fan structure, and a terminal zone tapered radially inwardly from said center zone as it extends away from said fan, said center zone being dimensioned relative to said duct to define an annular an annular space between said center body and said duct in which fully developed turbulent flow is created, said annular space having a smaller cross-sectional area than a space between said central fan structure and said duct;

first side branch resonator means positioned within said first center body for attenuating resonance produced by said fan in at least one frequency band, said first resonator means including a first resonance chamber ported to the outside of said center body at a plurality of circumferentially space-apart locations and a second resonance chamber connected in series with said first resonance chamber, said second resonance chamber being of a toroidal configuration and being ported at a plurality of axially spaced-apart locations on its inner surface;

a second elongated center body extending axially from said central fan structure in an upstream direction, being tapered radially inwardly in said upstream direction; and second side branch resonator means positioned within said second center body for receiving energy traveling upstream through said duct to attenuate resonance produced by said fan of at least one frequency band, said second side branch resonator being of a multi-stage configuration and having at least one resonance chamber that is ported to the outside of said second center body at a plurality of circumferentially spaced-apart locations.

* * * * *